United States Patent [19]

Augustin et al.

[11] Patent Number: 5,036,815

[45] Date of Patent: Aug. 6, 1991

[54] MECHANICAL INJECTION-PUMP GOVERNOR WITH AN ELECTRONICALLY CONTROLLED TORQUE CONTROL

[75] Inventors: Ulrich Augustin, Kernen; Bernd Busenthür, Stuttgart, both of Fed. Rep. of Germany

[73] Assignee: Daimler-Benz AG, Fed. Rep. of Germany

[21] Appl. No.: 515,828

[22] Filed: Apr. 27, 1990

[30] Foreign Application Priority Data

Apr. 29, 1989 [DE] Fed. Rep. of Germany ..... 3914263

[51] Int. Cl.[5] ..... F02D 31/00

[52] U.S. Cl. ..... 123/358; 123/357; 123/373

[58] Field of Search ..... 123/357, 358, 359, 372, 123/373, 382, 383, 364

[56] References Cited

U.S. PATENT DOCUMENTS

| | | | |
|---|---|---|---|
| T998,002 | 9/1980 | Miller | 123/358 |
| 4,212,279 | 7/1980 | Ohanti | 123/357 |
| 4,220,502 | 6/1981 | Seilly | 123/357 |
| 4,223,653 | 9/1980 | Jaenke | 123/382 |
| 4,243,004 | 1/1981 | Ritter | 123/358 |
| 4,286,559 | 9/1981 | Ritter | 123/383 |
| 4,434,761 | 3/1984 | Ludwig | 123/383 |
| 4,495,914 | 1/1985 | Ishii | 123/357 |
| 4,576,130 | 3/1986 | Hafele | 123/357 |

FOREIGN PATENT DOCUMENTS

| | | |
|---|---|---|
| 2453576 | 5/1976 | Fed. Rep. of Germany . |
| 2804038 | 8/1979 | Fed. Rep. of Germany . |
| 3243349 | 5/1984 | Fed. Rep. of Germany . |

*Primary Examiner*—Carl Stuart Miller

*Attorney, Agent, or Firm*—Evenson, Wands, Edwards, Lenahan & McKeown

[57] ABSTRACT

A mechanical injection-pump governor with an electronically controlled torque-control in which, as a function of parameters, a stepping motor controllable by an electronic control device adjusts with its actuator a full-load stop interacting with the quantity-adjustment member of the injection pump. The torque-control movement of the actuator is limited by an end stop situated a short distance above the maximum full-load control path and by an end stop situated a short distance below the minimum full-load control path.

6 Claims, 1 Drawing Sheet

MECHANICAL INJECTION-PUMP GOVERNOR WITH AN ELECTRONICALLY CONTROLLED TORQUE CONTROL

BACKGROUND AND SUMMARY OF THE INVENTION

The present invention relates to a mechanical injection-pump governor with an electronically controlled torque control with a stepping motor that adjusts with its actuator a yielding full load stop that interacts with an adjustment member of an injection pump, with an end stop for the actuator serving as a reference point for adjustment of the actuator.

German Patent Application DE 32 43 349 A1 discloses a torque control with a stepping motor that via its actuator, actuates a lever which is pivotable about a pivot and the free end of which has the yielding full-load stop for the quantity-adjustment member of an injection pump designed as a distributor pump. A drag lever forming part of a governor linkage connection is placed with prestress against the full-load stop.

The actuator having the yielding full-load stop is bounded by an end stop arranged in the governor housing. This end stop serves as a reference point to secure a new torque-control setting before any setting of a new control value. The new control value is formed by an electronic control device from operating parameters of the internal-combustion engine and is output to the stepping motor as counted actuating steps. The actuator is driven to the end stop and is brought from there into the desired end position by the number of steps corresponding to the control value to be set.

An object of the present invention is to provide a torque control with which it is possible to carry out new torque-control adjustments in an improved manner, such that, in the event of a failure of torque control in an arbitrary position (i.e. the instantaneous position), emergency running is possible while avoiding impermissible exhaust gas emissions. This needs to be done without damage to the engine occurring and without the engine speed falling below a speed necessary for maintaining the operation of the internal-combustion engine.

This and other objects are attained by the present invention which provides a mechanical injection-pump governor with an electronically controlled torque control that operates on an adjustment member of an injection pump. The governor includes a yielding full-load stop interacting with the adjustment member of the injection pump, and a stepping motor having an actuator. This actuator is coupled to the yielding full-load stop, the stepping motor adjusting the yielding full-load stop via movement of the actuator along a full-load control path. The actuator has a projection on it. A first end stop serves as a reference point for the movement of the actuator. This first end stop is positioned a short distance beyond a maximum of the full-load control path of the actuator in a first moving direction of the actuator. A second end stop is positioned a short distance beyond a minimum of the full-load control path of the actuator in a second moving direction of the actuator. This second moving direction is opposite to the first moving direction. The first and second end stops interact with the projection to limit a torque-control range of the injection pump.

An advantage of the present invention is that in the event of a failure of torque control, the full-load characteristic of the engine is neither critically exceeded (with regard to increased exhaust gas emissions) nor critically fallen below. This ensures that proper engine operation is maintained. Another advantage, when there is trouble-free engine operation, is the provision of a very small distance between an end stop and the full-load control path nearest to the end stop at a certain speed value. This allows readjustments for small paths of the stepping motor without prejudicing the operating behavior of the internal-combustion engine.

Other objects, advantages and novel features of the present invention will become apparent from the following detailed description of the invention when considered in conjunction with the accompanying drawings.

DETAILED DESCRIPTION OF THE DRAWINGS

Figure 1:
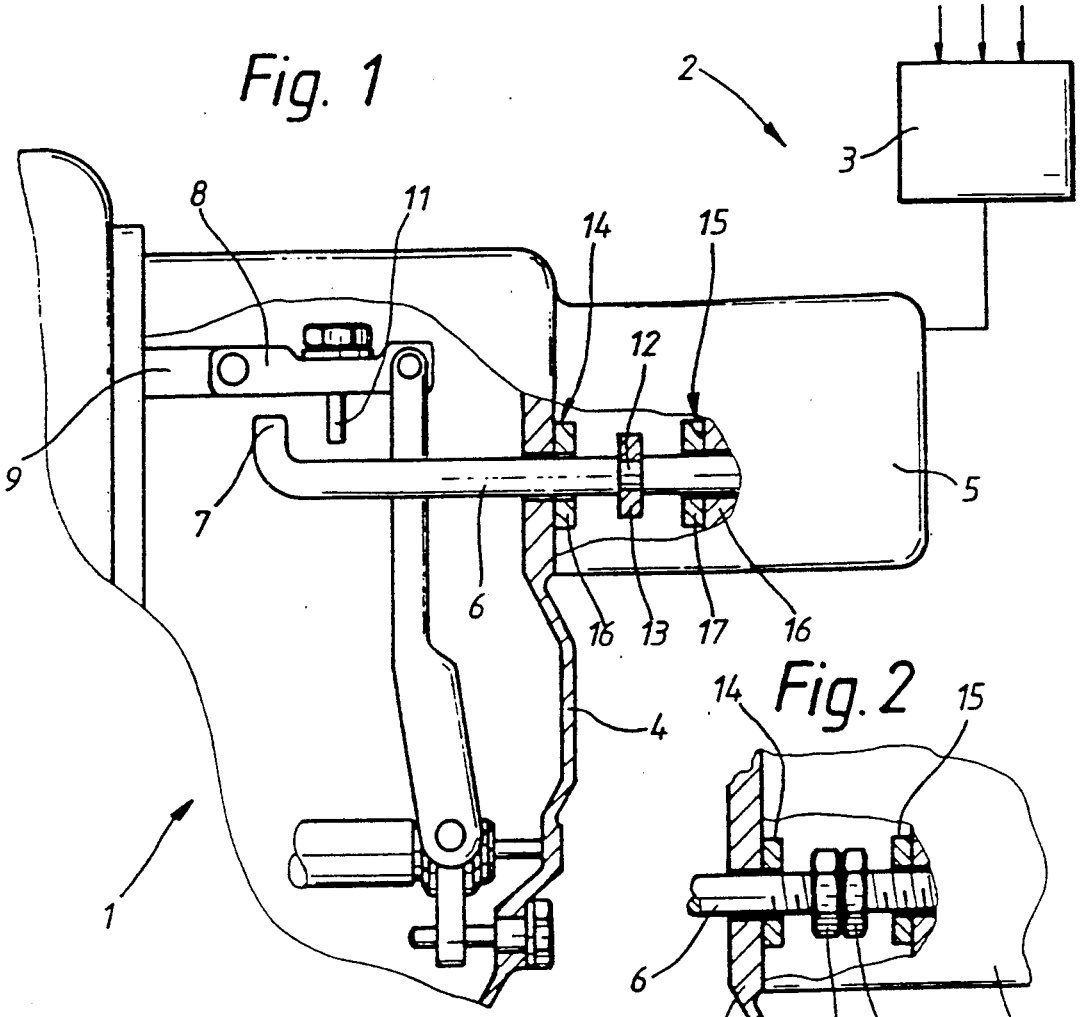
FIG. 1 shows a torque control secured on an injection-pump governor, constructed in accordance with an embodiment of the present invention, and which has a snap ring on an actuator.

FIG. 1 shows a mechanical injection-pump governor 1 for an internal-combustion engine run on diesel fuel that is operatively coupled to an electronically controlled torque control 2 comprising a conventional electronic control device 3 and a stepping motor 5. The control device 3 controls the stepping motor 5. This stepping motor 5 is secured on an end face of a governor housing 4.

The control device 3 processes parameters, such as charge-air temperature, charge-air pressure, speed, etc., to form a control value for the control of the stepping motor 5. The stepping motor 5 has a rod-shaped actuator 6, that forms a yielding full-load stop 7 for a quantity-adjustment member of an injection pump !0 provided as an in-line injection pump. The quantity adjustment-member comprises in the embodiment of FIG. 1 an articulated fork 8 and a control rod 9. The free end of the actuator 6 is bent upwards at a right angle and represents the full-load stop 7. This full-load stop 7 interacts with counterstop 11, which is formed as a pin. The counterstop 11 is arranged on the articulated fork 8 and, in full-load operation of the internal-combustion engine, effects a parameter-dependent torque control.

The rod-shaped actuator 6 is furthermore provided with a projection as a stop part. In the embodiment of FIG. 1, this projection is formed by a snap ring 13 which is slipped on, lies in a snap-in groove 12 and, together with an end stop 14 arranged on the governor-housing side and with a further end stop 15 on a housing part !6 of the stepping motor 5, limits the torquecontrol path of the actuator 6.

Figure 3:
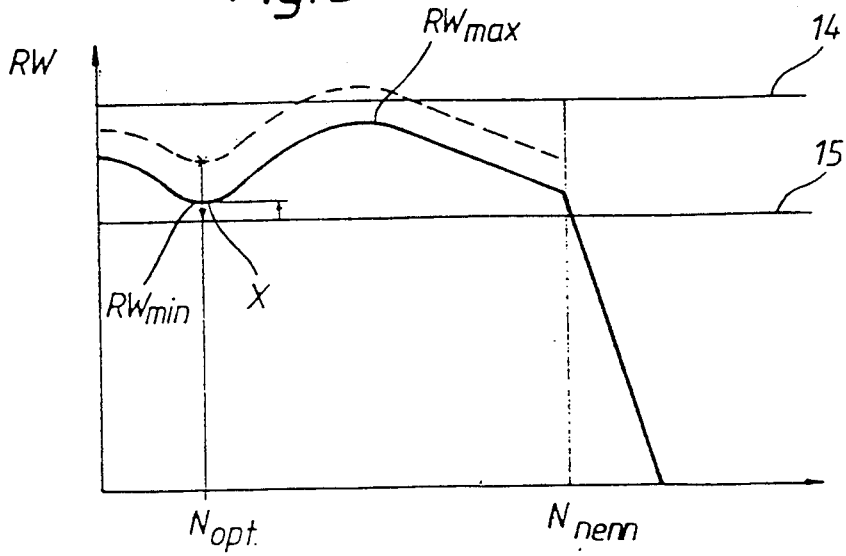
FIG. 3 is a control path/speed diagram showing the full-load control path and the torque-control adjustment range.

In FIG. 3, the end stop 14 is a short distance above the maximum full-load control path (RW max) of the actuator 6 and the end stop 15 is a short distance below the minimum full-load control path (RW min). In the event a readjustment is desired, the lower end stop 15 can expediently be used as a reference point for resetting the stepping motor 5 at a certain speed since it is here that he smallest distance form the minimum full-load control path 14 occurs. The stepping motor 5 can be brought into a desired position x from this reference point with its actuator 6 using an instantaneously present control value, which corresponds to a certain number of steps. The resetting of the stepping motor 5 does not disturb the operating behavior of the internal-combustion engine.

Since the torque-control range limited by the end stops 14, 15 depends on the engine type and power variant, the torquecontrol range can be extended or restricted in a simple manner by distance washers 16, 17. The distance washer 16 is secured on the governor housing 4 and distance washer 17 is secured on a housing part of the stepping motor 5.

Figure 2:
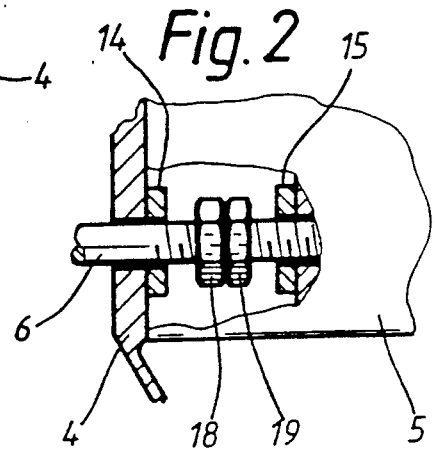
FIG. 2 shows an actuator with lock nuts.

In the embodiment of FIG. 2, lock nuts !8, 19 are used for the adjustment and readjustment. These lock nuts 18, 19 are provided on a portion of the actuator 6 that is threaded, and replace the snap ring of the FIG. 1 embodiment.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A mechanical injection-pump governor with an electronically controlled torque control that operates on an adjustment member of an injection pump, comprising:

a yielding full-load stop interacting with the adjustment member of the injection pump;

a stepping motor having an actuator, said actuator being coupled to said yielding full-load stop, said stepping motor adjusting the yielding full-load stop via movement of said actuator along a full-load control path;

a projection on said actuator;

a first end stop positioned a short distance beyond a maximum of the full-load control path of the actuator in a first moving direction of the actuator; and a second end stop positioned a short distance beyond a minimum of the full-load control path of the actuator in a second moving direction of the actuator, the second moving direction being opposite the first moving direction;

wherein at least one of said first and second end stops serves as a reference point for the movement of the actuator, said first and second end stops interacting with said projection to limit a torque-control range of the injection pump.

2. The injection-pump governor of claim 1, further comprising a housing part for the stepping motor, and an injection-pump governor housing, and wherein the first end stop is formed by the injection-pump governor housing and the second end stop is formed by said housing part.

3. The injection-pump governor of claim 2, further comprising a distance washer surrounding the actuator and secured on said governor housing.

4. The injection-pump governor of claim 2, further comprising a distance washer surrounding the actuator and secured on said housing part.

5. The injection-pump governor of claim 1, wherein the actuator is a reciprocating rod, and the projection is a snap ring arranged between the first and second end stops.

6. The injection governor according to claim 1, wherein the actuator is a threaded rod, and the projection comprises lock nuts.

* * * * *